US005248431A

United States Patent [19]

Fujita et al.

[11] Patent Number: 5,248,431

[45] Date of Patent: Sep. 28, 1993

[54] METAL WORKING LUBRICATING COMPOSITION

[75] Inventors: Takeshi Fujita; Takeshi Kawano, both of Kyoto, Japan

[73] Assignee: Dai-Ichi Kogyo Keiyaku Co., Ltd., Kyoto, Japan

[21] Appl. No.: 882,353

[22] Filed: May 6, 1992

Related U.S. Application Data

[63] Continuation of Ser. No. 650,139, Feb. 4, 1991, abandoned.

[30] Foreign Application Priority Data

Feb. 6, 1990 [JP] Japan ..... 2-26897

[51] Int. Cl.[5] ..... C10M 173/00

[52] U.S. Cl. ..... 252/49.3; 252/51.5 R; 252/56 R; 252/56 D; 72/42

[58] Field of Search ..... 252/49.3, 56 R, 56 D; 72/42

[56] References Cited

U.S. PATENT DOCUMENTS

| | | | |
|---|---|---|---|
| 2,542,550 | 2/1951 | McDermott | 252/56 D |
| 3,492,232 | 1/1970 | Rosenberg | 252/49.3 |
| 3,791,971 | 2/1974 | Lowe | 252/56 R |
| 3,838,052 | 9/1974 | Miller | 252/56 D |
| 4,172,802 | 10/1979 | Rieder | 252/49.3 |
| 4,461,712 | 7/1984 | Jonnes | 252/49.3 |
| 4,585,565 | 4/1986 | Tsai | 252/49.5 |
| 4,606,833 | 8/1986 | Schuettenberg et al. | 252/49.3 |
| 4,812,248 | 3/1989 | Marwick | 72/42 |

FOREIGN PATENT DOCUMENTS 59-142294 8/1984 Japan .

OTHER PUBLICATIONS

Smalheer et al., "Lubricant Additives", pp. 1-11, 1967.

*Primary Examiner*—Ellen M. McAvoy
*Attorney, Agent, or Firm*—Jordan and Hamburg

[57] ABSTRACT

A lubricating composition for the manufacture and surface treatment of metallic pipe, wire, sheet and so on contains a high molecular polyester or polyurethane having a weight average molecular weight of not less than 10,000 which is the product of reacting a polyalkylene oxide compound formed by on addition-polymerization of an ethylene oxide-containing alkylene oxide and an organic compound having two active hydrogen groups with a polycarboxylic acid or the corresponding anhydride or lower alkyl ester to form the polyester or with a diisocyanate to form the polyurethane. The composition forms a highly lubricating film, and since this film is readily soluble in water and organic solvents, residues of the lubricating composition on the treated surface can be easily dissolved off after metal working.

9 Claims, No Drawings

METAL WORKING LUBRICATING COMPOSITION

This application is a continuation of application Ser. No. 07/650,139, filed Feb. 4, 1991.

BACKGROUND OF THE INVENTION

The present invention relates to a lubricating composition for the manufacture and surface treatment of metallic pipe, wire, sheet and so on.

A variety of lubricants have been used in the manufacture of metallic pipe and wire rod, particularly in wire drawing. For example, oily lubricants based on animal, vegetable or mineral oil, aqueous lubricants prepared by emulsifying such oils, systems prepared by adding an extreme pressure additive to such lubricants, chlorine-containing oily polymers, and solid lubricants such as calcium stearate are known and mainly employed. After the metal working, the oily residue on the surface of the product is generally removed with a halogen-containing solvent.

Although these metal working lubricants have been considered more or less satisfactory in terms of lubricating effect, each of them has its own drawbacks, e.g. poor skin quality after processing (rough surface), early wear and consequent short lives of dies, and poor labor hygiene and fire hazard due to the organic solvent used for post-cleaning.

SUMMARY OF THE INVENTION

The object of the present invention is to provide a metal working lubricating composition which is characterized by (1) high solubility in water, a high affinity for oils and other contaminants and ease of removal in the cleaning stage after working without safety problems, (2) an attractive finished metal surface after working (smooth surface), and (3) a reduced wear and, hence, an extended service life of dies.

The present invention is accordingly concerned with a metal working lubricating composition essentially comprising a high molecular polyester or polyurethane having a weight average molecular weight of not less than 10,000 which is the product of by reacting a polyalkylene oxide compound formed by on addition-polymerization of an ethylene oxide-containing alkylene oxide and an organic compound having two active hydrogen groups with a polycarboxylic acid or the corresponding anhydride or lower alkyl ester to form the polyester or with a diisocyanate to form the polyurethane.

DETAILED DESCRIPTION OF THE PREFERRED EMBODIMENTS

The polyalkylene oxide compound to be employed as a starting material for the high molecular compound of the invention can be prepared by addition-polymerizing an ethylene oxide-containing alkylene oxide with an organic compound having two active hydrogen groups.

The organic compound having two active hydrogen groups includes, inter alia, ethylene glycol, propylene glycol, polyethylene glycol, polypropylene glycol, butylamine, polytetramethylene glycol, aniline and so on.

The ethylene oxide-containing alkylene oxide to be addition-polymerized with such an organic compound having two active hydrogen groups is either ethylene oxide as such or an alkylene oxide containing a predominant proportion of ethylene oxide. The alkylene oxide other than ethylene oxide is preferably a compound containing 3 to 30 carbon atoms. For example, propylene oxide, butylene oxide, styrene oxide, etc. as well as $\alpha$-olefin oxides of 3 to 30 carbon atoms and glycidyl ethers of 3 to 30 carbon atoms can be employed. The preferred proportion of ethylene oxide in the total alkylene oxide is 70 to 100 weight percent.

The addition-polymerization reaction between said organic compound having two active hydrogen groups and said alkylene oxide can be carried out in the known manner.

The weight average molecular weight of the resulting polyalkylene oxide compound is preferably not less than 100. If the weight average molecular weight is less than 100, the object of the invention may not be accomplished.

The polycarboxylic acid or corresponding lower alkyl ester to be reacted with said polyalkylene oxide compound includes, inter alia, phthalic acid, isophthalic acid, terephthalic acid, sebacic acid, etc. and the corresponding dimethyl, diethyl and other esters. The polycarboxylic anhydride includes, inter alia, tetracarboxylic anhydrides such as pyromellitic anhydride and so on.

The diisocyanate to be reacted with said polyalkylene oxide compound includes all the common diisocyanates such as tolylene diisocyanate, hexamethylene diisocyanate, isophorone diisocyanate and so on. Aside from these diisocyanates, isocyanato-terminated urethane prepolymers obtainable by prepolymerizing such diisocyanates with, for example, polypropylene glycol can also be employed as said diisocyanate.

The polyester-forming reaction between the polyalkylene oxide compound and the polycarboxylic acid or the corresponding anhydride or lower alkyl ester and the polyurethane-forming reaction between the polyalkylene oxide compound and the diisocyanate tend to be accompanied by thermal decomposition and, therefore, these reactions are preferably conducted in a closed reactor.

The charging ratio of said polyalkylene oxide compound to said polycarboxylic acid, anhydride or lower alkyl ester or diisocyanate is virtually optional, provided that the weight average molecular weight of the product high molecular compound is not less than 10,000.

For use as a metal working lubricant, the resulting high molecular compound is dissolved in water or an organic solvent at a concentration of 0.1 to 10 weight %. The organic solvent is preferably a halogen-containing solvent, such as trichloroethane, dichloroethane, etc., although virtually any organic solvent capable of dissolving said high molecular compound can be employed.

The use of an extreme pressure additive in combination with the composition of the present invention results in still improved results. The extreme pressure sure additive assists in interface lubrication under high load and can be any of the organic sulfur and/or phosphorus compounds which are commonly used. Typical examples are sulfidized oils and thiophosphates. Chlorinated paraffin can also be employed. The preferred level of addition of such extreme pressure additive is 0.5 to 20 weight % based on the whole lubricating composition.

The use of a polyhydric alcohol fatty acid ester in conjunction also insures still better results. This type of ester assists in lubrication and release. The constituent polyhydric alcohol includes, inter alia, sorbitan, sorbitol, pentaerythritol, glycerin, trimethylolpropane, sucrose and the like. The constituent fatty acid includes, inter alia, lauric acid, stearic acid, oleic acid, linoleic acid, linolenic acid and so on. The polyhydric alcohol fatty acid ester can be produced by reacting these two constituent materials in the routine manner. The ester with an esterification degree of not less than 0.9 is generally employed. The preferred level of addition is 1.0 to 20 weight % based on the whole lubricating composition.

Following this treatment of the metal surface with the lubricating composition of the invention, it is good practice to deposit a solid lubricant, such as sodium stearate, calcium stearate or the like, on the treated surface.

The metal working lubricating composition of the present invention has an excellent lubricating film-forming ability and since this film is readily soluble in water and organic solvents, the residues on the worked metal surface can be easily dissolved off, thus permitting a drastic simplification of the cleaning and washing process. Particularly when post-cleaning is carried out with water, no attention need be paid to the risk of fire or the toxicological potential to man, and this means an economic advantage. Furthermore, the lubricating film is so flexible and adherent to the metal surface and so lean in impurity that the wear of the dies is minimized and the worked metal surface assumes an improved gloss which leads to an enhanced value of the finished product.

The following examples and comparative example are merely intended to illustrate the invention in further detail and should by no means be construed as defining the metes and bounds of the invention.

EXAMPLE 1

To 100 parts (weight parts; the same applies hereinafter) of polyethylene glycol (weight average molecular weight 10,000) was added 2.2 parts of dimethyl terephthalate and the esterification reaction was carried out to prepare a high molecular compound having a weight average molecular weight of 130,000 (hereinafter referred to as high molecular compound A).

Then, 20 parts of this high molecular compound A, 5 parts of an S-P extreme pressure additive (S 12.2%, P 0.25%) and 5 parts of sorbitan oleate were mixed and dispersed in 70 parts of water. A stainless steel wire rod (SUS 304) was coated with the above viscous fluid, followed by application of calcium stearate powder on the coated surface. The wire rod was then drawn to give a wire 2 mm in diameter.

This wire was passed through a 5% aqueous solution of potassium hydroxide at a draft speed of 10 m/min., whereby its surface was cleaned to a degree of cleanliness equal to 98%. The surface of the treated wire presented a neat finished appearance.

EXAMPLE 2

One-hundred (100) parts of polypropylene glycol (weight average molecular weight 2,000) and 1,900 parts of ethylene oxide were addition-polymerized and, then, the esterification reaction was carried out using 20 parts of dimethyl sebacate to give a high molecular compound having a weight average molecular weight of 200,000 (hereinafter referred to as high molecular compound B).

In 73 parts of water were dissolved and dispersed 15 parts of the above high molecular compound B, 10 parts of the same extreme pressure additive as used in Example 1 and 2 parts of sorbitan oleate to prepare a viscous fluid. This fluid was coated on a steel sheet for deep drawing. On top of this coating was deposited a mixture of 20 parts of mixed sodium stearate-calcium stearate powder (1:1, w/w) and 5 parts of polyoxyethylene lauryl ether phosphate and the plate thus treated was deep-drawn to construct a cylindrical container. The required punch pressure was 70% of the pressure necessary with the conventional lubricant.

The contaminant dirt on the surface of this cylindrical container could be easily removed by brushing with 40° C. lukewarm water.

EXAMPLE 3

A polytetramethylene glycol (weight average molecular weight 2,000)-ethylene oxide adduct having a weight average molecular weight of 10,000 was reacted with hexamethylene diisocyanate to give a polyurethane compound having a weight average molecular weight of 120,000 (hereinafter referred to as high molecular compound C).

A paste lubricant was then prepared using 25 parts of the above high molecular compound C, 10 parts of the same extreme pressure additive as used in Example 1, 10 parts of glycerin monooleate, 5 parts of polyoxyethylene lauryl ether phosphate amine salt (neutral) and 50 parts of water. When this paste was used as a lubricant for pipe enlargement, a neat finished surface was obtained as the contaminant dirt was effectively removed by mere rinsing with high efficiency.

COMPARATIVE EXAMPLE 1

The same metal working operation as in Example 1 was carried out using a lubricant containing a purified mineral oil emulsified in water with polyoxyethylene octylphenyl ether, the same extreme pressure additive as used in Example 1 and sorbitan oleate.

In this wire drawing operation, no serious trouble was encountered. After the operation, however, the degree of cleanliness achieved was less than 70% even after several washings with an aqueous solution of potassium hydroxide.

What is claimed is:

1. A lubricating composition for metal working consisting essentially of a 0.1 to 10 weight % concentration solution in water of a high molecular polyester or polyurethane having a weight average molecular weight of not less than 10,000 which is the product of reacting a polyalkylene oxide compound having a weight average molecular weight of at least 100 formed by addition-polymerization of an ethylene oxide-containing alkylene oxide and an organic compound having two active hydrogen groups with a polycarboxylic acid or the corresponding anhydride or lower alkyl ester to form said polyester or with a diisocyanate to form said polyurethane and, optionally, at least one of (a) an organic sulfur and/or phosphorous compound in a proportion of 0.5 to 20 weight %, based on the weight of the entire lubricating composition, and (b) a polyhydric alcohol fatty acid ester in a proportion of 1.0 to 20 weight %, based on the weight of the entire lubricating composition.

2. A lubricating composition according to claim 1, in which the polyalkylene oxide incorporates at least 70 weight % ehthylene oxide and the balance at least one 3 to 30 carbon atom alkylene oxide.

3. A lubricating composition according to claim 2, in which the degree of esterification of the polyhydric alcohol fatty acid ester is at least 0.9.

4. A lubricating composition for metal working consisting essentially of a 0.1 to 10 weight % concentration solution in water of a high molecular polyurethane having a weight average molecular weight of not less than 10,000 which is the product of reacting a polyalkylene oxide compound having a weight average molecular weight of at least 100 formed by addition-polymerization of an ehtylene oxide-containing alkylene oxide and an organic compound having two active hydrogen groups with a diisocyanate to form said polyurethane and, optionally, at least one of (a) an organic sulfur and/or phosphorous compound in a proportion of 0.5 to 20 weight %, based on the weight of the entire lubricating composition, and (b) a polyhydric alcohol fatty acid ester in a proportion of 1.0 to 20 weight %, based on the weight of the entire lubricating composition.

5. A lubricating composition according to claim 4, in which the polyalkylene oxide incorporates at least 70 weight % ethylene oxide and the balance at least one 3 to 30 carbon atom alkylene oxide.

6. A lubricating composition according to claim 5, in which the degree of esterification of the polyhydric alcohol fatty acid ester is at least 0.9.

7. A lubricating composition for metal working consisting essentially of a 0.1 to 10 weight % concentration solution in water of a high molecular polyester or polyurethane having a weight average molecular weight of not less than 10,000 which is the product of reacting a plyalkylene oxide compound having a weight average molecular weight of at least 100 formed by addition-polymerization of an ethylene oxide-containing alkylene oxide and an organic compound having two active hydrogen groups with a polycarboxylic acid or a corresponding anhydride or lower alkyl ester to form said polyester or with a diisocyanate to form said polyurethane and a polyhydric alcohol fatty acid ester in a proportion of 1.0 to 20 weight %, based on the weight of the entire lubricating composition and, optionally, an organic sulfur and/or phosphorous compound in a proportion of 0.5 to 20 weight %, based on the weight of the entire lubricating composition.

8. A lubricating composition according to claim 7, in which the polyalkylene oxide incorporates at least 70 weight % ethylene oxide and the balance at least one 3 to 30 carbon atom alkylene oxide.

9. A lubricating composition according to claim 8, in which the degree of esterification of the polyhydric alcohol fatty acid ester is at least 0.9.

* * * * *